United States Patent [19]

Chen et al.

[11] Patent Number: 4,877,724

[45] Date of Patent: Oct. 31, 1989

[54] METHOD AND COMPOSITION FOR HARDENING GELATIN

[75] Inventors: Chung Y. Chen, Rochester; Edgar E. Riecke, Webster; Kenneth G. Harbison; Derek D. Chapman, both of Rochester, all of N.Y.

[73] Assignee: Eastman Kodak Company, Rochester, N.Y.

[21] Appl. No.: 238,665

[22] Filed: Aug. 31, 1988

Related U.S. Application Data

[63] Continuation-in-part of Ser. No. 22,192, Mar. 5, 1987, abandoned.

[51] Int. Cl.[4] ..... G03C 1/30

[52] U.S. Cl. ..... 430/621; 430/623; 430/631; 430/638; 530/354

[58] Field of Search ..... 430/621, 623, 625; 530/354

[56] References Cited

U.S. PATENT DOCUMENTS

| | | | |
|---|---|---|---|
| 3,947,274 | 3/1976 | Mikawa et al. | 430/621 |
| 4,013,468 | 3/1977 | Bergthaller et al. | 530/354 |
| 4,119,464 | 10/1978 | Sauerteig et al. | 430/621 |
| 4,421,847 | 12/1983 | Jung et al. | 430/623 |
| 4,612,280 | 9/1986 | Okamura et al. | 430/621 |

FOREIGN PATENT DOCUMENTS

| | | |
|---|---|---|
| 162308 | 11/1985 | European Pat. Off. . |
| 20369 | 2/1984 | Japan . |

OTHER PUBLICATIONS

Journal of the American Chemical Society, 103, 4837–45 (1981).

Chem. Ber., 119, 3276–97 (1986).

*Primary Examiner*—Paul R. Michl

*Assistant Examiner*—Mark R. Buscher

*Attorney, Agent, or Firm*—Paul L. Marshall

[57] ABSTRACT

A method for hardening gelatin comprising combining the gelatin to be hardened with a compound of the formula:

wherein $R_1$, $R_2$, $R_3$, $R_4$, $R_5$, $R_6$, and $X^{\ominus}$ are as herein defined. The compounds of this formula effectively harden gelatin with little or no after-hardening. These compounds are useful in hardening gelatin in photographic elements.

29 Claims, 3 Drawing Sheets

METHOD AND COMPOSITION FOR HARDENING GELATIN

This application is a continuation-in-part of U.S. application Ser. No. 022,192 filed Mar. 5, 1987, now abandoned.

FIELD OF THE INVENTION

This invention relates to a method and hardener composition for hardening gelatin, particularly in photographic elements.

BACKGROUND OF THE INVENTION

Gelatin is commonly used as a vehicle in photographic materials. Quite often, numerous layers in photographic elements, such as light-sensitive silver halide layer, filter layers, backing layers, antihalation layers, and overcoat layers, use gelatin as the primary binder.

Photographic elements are generally processed in aqueous processing solutions. Such processing results in excessive swelling and loss of strength of the gelatin binder unless the gelatin has been hardened. If the processing solution is maintained at a warm temperature, e.g., 40° C., the gelatin binder can dissolve, causing the layers of the element to disintegrate, unless the gelatin has been hardened.

A number of compounds have been used to harden gelatin. These include formaldehyde and free aldehydes as described in U.S. Pat. No. 3,232,764, active esters as described in U.S. Pat. No. 3,542,558, epoxy compounds as described in U.S. Pat. No. 3,047,394, aziridines as described in U.S. Pat. No. 2,950,197, and others well-known in the art. These compounds harden, or cross-link, gelatin, thus increasing its mechanical strength and reducing the swellability and solubility of the gelatin in aqueous processing solutions.

The above-described hardening compounds are, however, subject to a number of disadvantages. Some take an exceedingly long time after being cast and dried to give the desired degree of gelatin hardening, requiring elements containing gelatin hardened with those compounds to be aged for an extended time while the hardening process is completed. In other words, these hardeners exhibit after-hardening. Additionally, a number of compounds exhibit adverse effects on the photographic properties of elements in which they are used. Such adverse effects can include an increase in fog or a reduction in light sensitivity or photographic speed.

In order to avoid the time and expense of keeping large quantities of gelatin-containing photographic elements for long periods while the hardening process is completed, a number of so-called fast-acting hardeners have been described in the art. For example, U.S. Pat. No. 4,063,952 describes a carbamoyl pyridinium hardening compound in which the pyridine ring carries a sulfoalkyl substituent. European patent application No. 162,308 describes a chloroformamidinium hardener, and U.S. Pat. No. 4,612,280 describes an N-succinimidyloxyformamidinium hardener. These hardeners, however, suffer from a number of problems. Some of these hardeners exhibit after-hardening. Others have severe handling difficulties due to their hygroscopic nature, or poor hydrolytic stability, or both. Also, some of these hardeners adversely affect either the physical properties of photographic elements in which they are used (e.g., tackiness), or their sensitometric properties (e.g., speed loss). These problems are often aggravated by the fact that relatively large amounts of hardener are often required to achieve the desired hardening effect, leading to relatively large amounts of sometimes deleterious by-products.

It is therefore desirable to provide a hardener that effectively hardens gelatin in a short period of time, while substantially avoiding or reducing many of the above-described adverse effects. It is toward that end that the present invention is directed.

SUMMARY OF THE INVENTION

The present invention provides rapid hardening of gelatin with relatively small amounts of hardener while reducing many of the adverse side-effects, such as after-hardening or adverse effects on photographic properties. This is accomplished by combining gelatin with a compound of the formula:

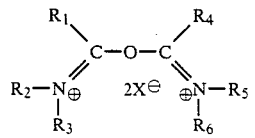

(I)

In this formula, $R_1$ represents hydrogen, alkyl, aralkyl, aryl, alkenyl, $-YR_7$, the group

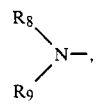

the group

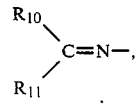

with Y representing sulfur or oxygen, and $R_7$, $R_8$, $R_9$, $R_{10}$, and $R_{11}$ each independently representing alkyl, aralkyl, aryl, or alkenyl. Alternatively, $R_8$ and $R_9$, or $R_{10}$ and $R_{11}$ may together form a ring structure. $R_{10}$ and $R_{11}$ may each also represent hydrogen. Also, $R_1$ together with $R_2$ may form a heterocyclic ring.

$R_2$ and $R_3$ each independently represents alkyl, aralkyl, aryl, or alkenyl, or, combined with $R_1$ or each other, forms a heterocyclic ring.

$R_4$, $R_5$, and $R_6$ are defined as are $R_1$, $R_2$, and $R_3$, respectively, and are the same as or different from $R_1$, $R_2$, or $R_3$.

$X^{\ominus}$ represents an anion or an anionic portion of the compound to form an intramolecular salt.

DETAILED DESCRIPTION OF THE INVENTION

Figure 1:
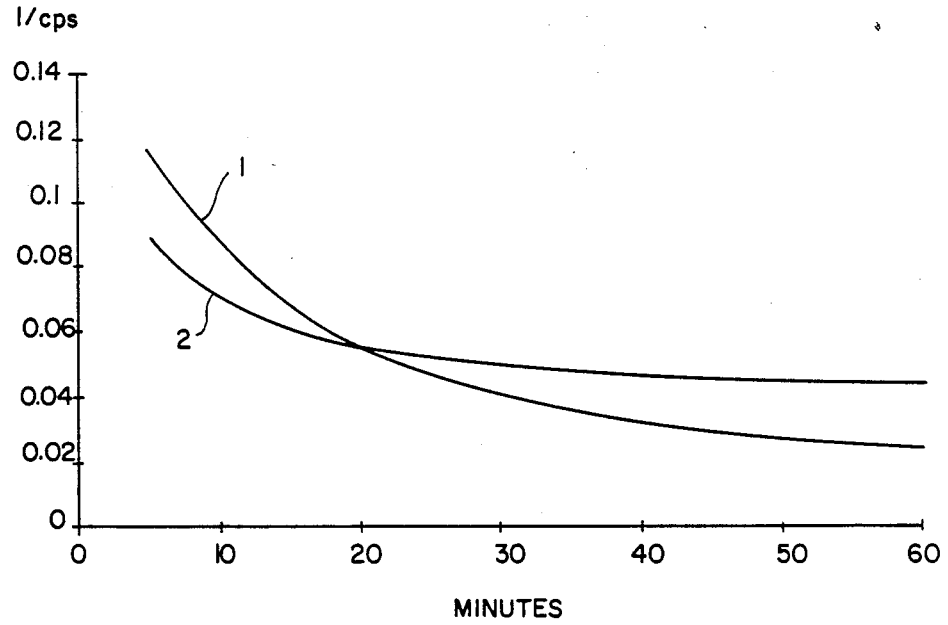
FIGS. 1-3 show plots of reciprocal viscosities versus time for test solutions containing gelatin hardened by hardener compounds of formula (I) with and without the presence of negatively-charged hydrophobic dispersions.

Compounds of the invention according to formula (I) are described in further detail below.

$R_1$ represents hydrogen, alkyl, aralkyl, aryl, alkenyl, $-YR_7$, the group

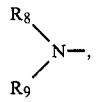

the group

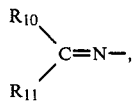

with Y representing sulfur or oxygen, and $R_7$, $R_8$, $R_9$, $R_{10}$, and $R_{11}$ each independently representing alkyl, aralkyl, aryl, or alkenyl. Alternatively, $R_8$ and $R_9$, or $R_{10}$ and $R_{11}$ may together form a ring structure. $R_{10}$ and $R_{11}$ may each also represent hydrogen. Also, $R_1$ together with $R_2$ may form a heterocyclic ring, which may be further condensed with another ring.

Preferably, $R_1$ is hydrogen, alkyl of 1 to 20 carbon atoms (e.g., methyl, ethyl, butyl, 2-ethylhexyl, or dodecyl), aralkyl of from 7 to 20 carbon atoms (e.g., benzyl, phenethyl), aryl of from 6 to 20 carbon atoms (e.g., phenyl, naphthyl), alkenyl of from 2 to 20 carbon atoms (e.g., vinyl, propenyl), the group

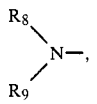

the group

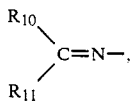

$R_1$ can combine with $R_2$ or $R_3$ to form a heterocyclic ring of 5 to 8 atoms. This ring contains the nitrogen atom to which $R_2$ and $R_3$ are attached in formula (I) and may contain an additional nitrogen atom, or an oxygen or sulfur atom. Examples of such rings include pyridine, quinoline, isoquinoline, thiazole, benzothiazole, thiazoline, oxazole, benzoxazole, imidazole, benzimidazole, and oxazoline.

$R_7$, $R_8$, $R_9$, $R_{10}$, and $R_{11}$ are preferably alkyl of 1 to 20 carbon atoms (e.g., methyl, ethyl, butyl, 2-ethylhexyl, or dodecyl), aralkyl of from 7 to 20 carbon atoms (e.g., benzyl, phenethyl), aryl of from 6 to 20 carbon atoms (e.g., phenyl, naphthyl), or alkenyl of from 2 to 20 carbon atoms (e.g., vinyl, propenyl).

$R_8$ and $R_9$, or $R_{10}$ and $R_{11}$ can also combine to form a ring structure of 5 to 8 atoms. The $R_8$–$R_9$ ring contains the nitrogen atom to which $R_8$ and $R_9$ are attached, and may also contain an additional nitrogen atom, or an oxygen or sulfur atom. The $R_{10}$–$R_{11}$ ring may also contain one or more nitrogen atoms, an oxygen atom, a sulfur atom, or any combination thereof. Examples of such rings include pyrrolidine, piperadine, and morpholine.

$R_2$ and $R_3$ each independently represents alkyl, aryl, aralkyl, alkenyl, or may combine with $R_1$ or each other to form a heterocyclic ring. Preferably, $R_2$ or $R_3$ may each be alkyl of 1 to 20 carbon atoms (e.g., methyl, ethyl, butyl, 2-ethylhexyl, or dodecyl), aralkyl of from 7 to 20 carbon atoms (e.g., benzyl, phenethyl), aryl of from 6 to 20 carbon atoms (e.g., phenyl, naphthyl), or alkenyl of from 2 to 20 carbon atoms (e.g., vinyl, propenyl). $R_2$ and $R_3$ also preferably combine with each other to form a heterocyclic ring of 5 to 8 atoms. This ring contains the nitrogen atom to which $R_2$ and $R_3$ are attached, and may also contain an additional nitrogen atom, or an oxygen or sulfur atom. Examples of such rings include pyrrolidine, piperadine, and morpholine. Either of $R_2$ or $R_3$ can combine with $R_1$ to form a heterocyclic ring, as described above in reference to $R_1$.

$R_4$, $R_5$, and $R_6$ are defined the same as described above for $R_1$, $R_2$, and $R_3$, respectively. $R_4$, $R_5$, and $R_6$ may each be the same as or different from $R_1$, $R_2$, and $R_3$.

$X^{\ominus}$ represents an anion or an anionic portion of the compound, which forms an intramolecular salt. Any anion that forms a salt compound according to formula (I) that is useful to harden gelatin according to the invention can be used. Preferred anions include a sulfonate ion such as methylsulfonate or p-toluene sulfonate $CF_3SO_3^{\ominus}$, $BF_4^{\ominus}$, $PF_6^{\ominus}$, and $ClO_4^{\ominus}$.

In addition to the above-described alkyl, aralkyl, aryl, alkenyl, and heterocyclic groups, groups, also useful as $R_1$, $R_2$, $R_3$, $R_4$, $R_5$, $R_6$, $R_7$, and $R_8$ include substituted alkyl, aralkyl, aryl, alkenyl, and heterocyclic groups. Useful substituents include halogen, alkoxy of from 1 to 20 carbon atoms, aryloxy of from 6 to 20 carbon atoms, a sulfo group, N,N-disubstituted carbamoyl, N,N-disubstituted sulfamoyl, and other groups known to those skilled in the art that do not prevent the compounds from functioning as hardeners according to the invention.

Examples of compounds of formula (I) are shown below in Table I.

TABLE I

| | Compound |
|---|---|
| 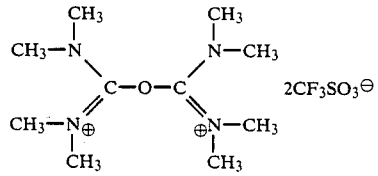 | 1 |

TABLE I-continued
| | Compound |
|---|---|
| 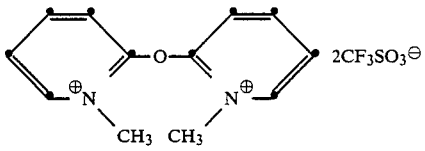 | 2 |
| 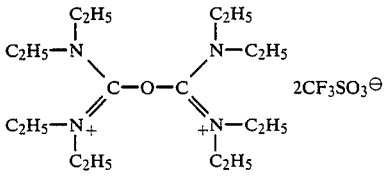 | 3 |
| 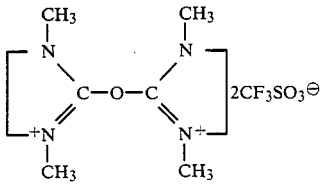 | 4 |
| 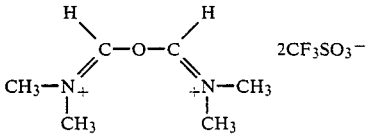 | 5 |
| 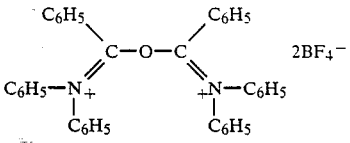 | 6 |
| 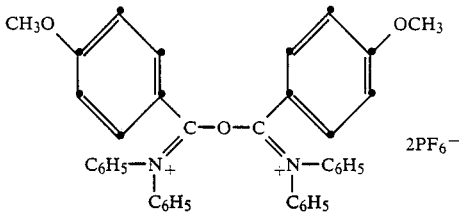 | 7 |
| 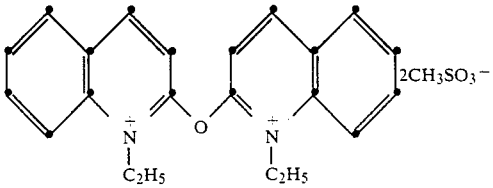 | 8 |
| 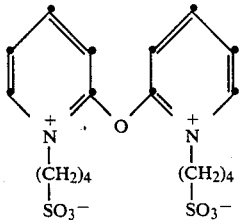 | 9 |

TABLE I-continued
| | Compound |
|---|---|
| 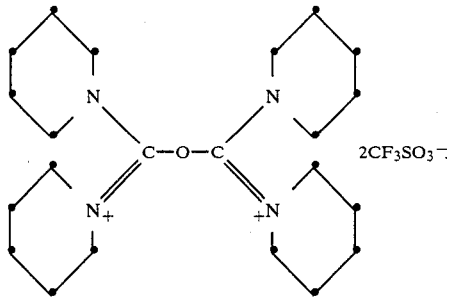 | 10 |
| 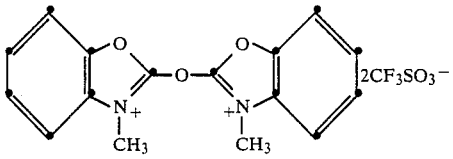 | 11 |
| 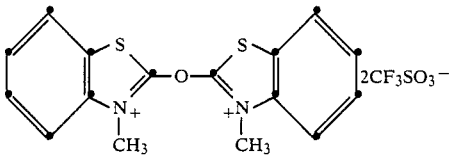 | 12 |
| 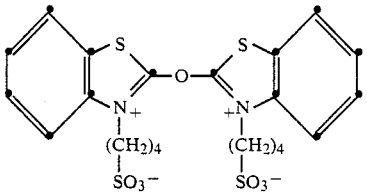 | 13 |
| 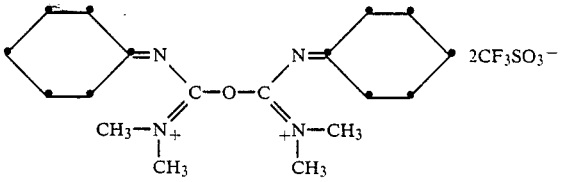 | 14 |
| 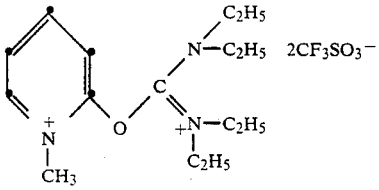 | 15 |
| 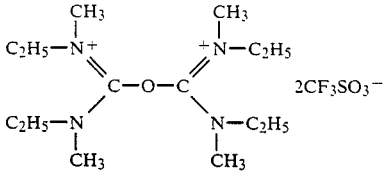 | 16 |
| 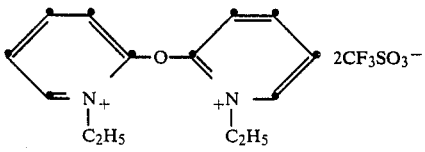 | 17 |

TABLE I-continued
| | Compound |
|---|---|
| 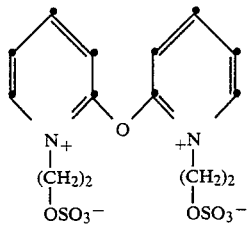 | 18 |
| 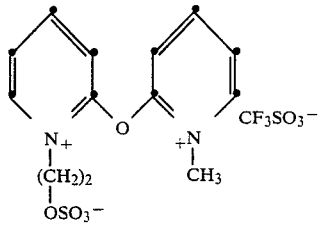 | 19 |
| 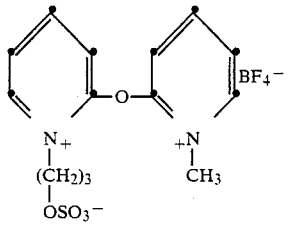 | 20 |
| 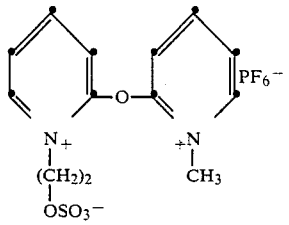 | 21 |
| 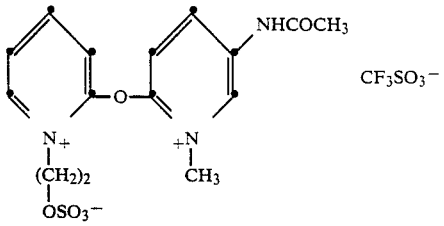 | 22 |
| 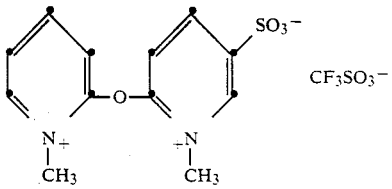 | 23 |
| 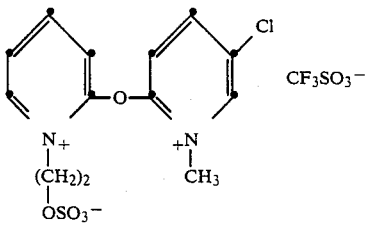 | 24 |

TABLE I-continued
| Compound | |
|---|---|
| 25 | 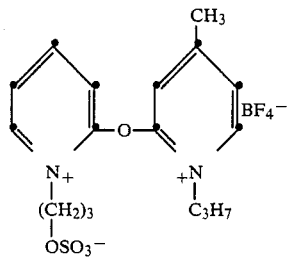 |
| 26 | 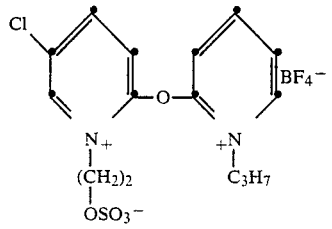 |
| 27 | 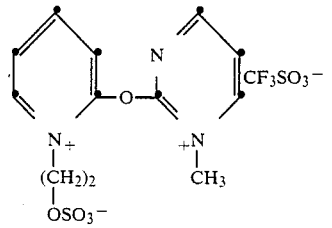 |
| 28 | 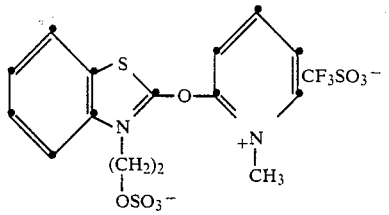 |
| 29 | 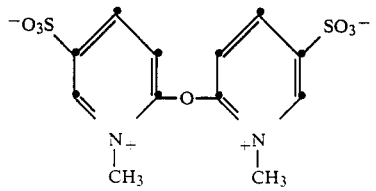 |
| 30 | 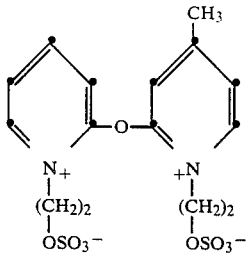 |

TABLE I-continued
| | Compound |
|---|---|
| 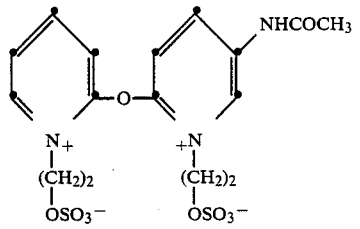 | 31 |
| 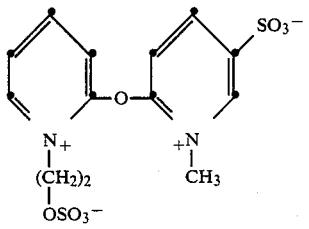 | 32 |
| 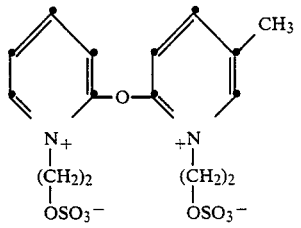 | 33 |
| 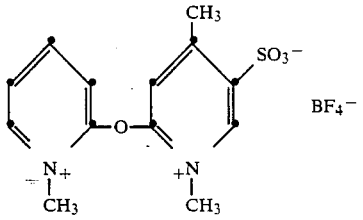 | 34 |
| 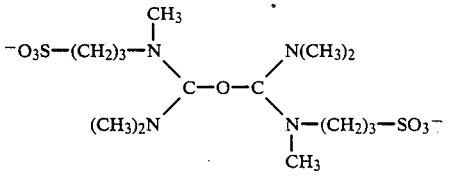 | 35 |
| 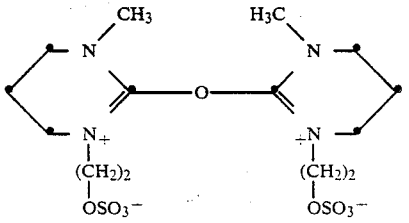 | 36 |
| 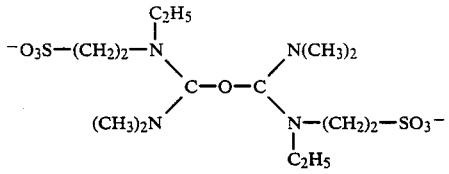 | 37 |
The compounds of formula (I) can be made by techniques known to those skilled in the chemical synthesis art. Useful synthesis techniques include those described in Journal of the American Chemical Society, 103, 4839

(1981). The preparation of compounds of formula (I) is further described below in the synthesis examples.

The compounds of formula (I) can be used to harden any type of gelatin. Types of gelatin useful in the practice of the present invention include alkali-treated gelatin, acid-treated gelatin, partially phthalated gelatin, double-dipped gelatin (i.e., gelatin treated with both alkali and acid), and the like.

The compounds of formula (I) provide rapid hardening of gelatin with little or no after-hardening while avoiding many of the adverse photographic effects found with prior art hardeners, such as speed loss and fog. The hardening compounds of formula (I) also are not highly hygroscopic as are many prior art hardening compounds, making them easy to handle. Additionally, the gelatin hardened according to the invention exhibits desirable physical properties, such as low tackiness.

According to the present invention, gelatin is hardened by combining it with a hardening compound according to formula (I). This is accomplished by techniques known to those skilled in the art. For example, the an aqueous solution of the hardening compound can be applied directly to an unhardened gelatin layer that has been coated on a support. Alternatively, the hardening compound can be mixed with the composition to be hardened shortly before coating it onto a support. Another way of using the compounds of formula (I) is to coat the compound in a gelatin or non-gelatin (e.g., synthetic polymer) layer as an overcoat or as an internal layer of a photographic element in a manner such that it will diffuse into other layers of the element to harden those other layers.

The compounds of formula (I) according to the invention can also be used to partially harden gelatin. This is done, for example, by increasing the chain length of the gelatin, as described in U.S. Pat. No. 4,421,847.

The amount of hardener used to harden gelatin according to the present invention will vary according to the purpose for which the gelatin is being used, the degree of hardening desired, and the particular compound of formula (I) that is used. If only a slight amount of hardening is desired, relatively small amounts of hardening compound can be used. If a greater degree of hardening is desired, relatively large amounts of hardener would be used. The amount of hardener used according to the present invention is preferably between 0.01 and 20 weight percent, based on the weight of dry gelatin, and more preferably between 0.05 and 10 weight percent, based on the weight of dry gelatin.

The hardening compound of formula (I) that is used in the present invention can be used alone, in combination with another hardening compound according to formula (I), or in combination with any of a number of hardening compounds or hardening accelerators known in the art. Examples of known hardening compounds include formaldehyde and free dialdehydes, sulfonate esters, epoxides, blocked active olefins, and others, as described in *Research Disclosure,* Item 17643, December, 1978 [hereinafter referred to as *Research Disclosure I*], Section X. Examples of known hardening accelerators include nonprotonic solvents, as described in German OLS No. 2,417,586, tert-amines and their salts, as described in British Pat. No. 1,269,983, and polyhydric alcohols.

The present invention is especially useful for hardening gelatin used in gelatin-containing layers in photographic elements. Such elements are well-known in the art. Examples of elements useful in the practice of the present invention include color negative film, color reversal film, color positive film, color print paper, color reversal print paper, black and white film, black and white paper, X-ray rilm, microfilm, and others well-known in the art. Color films and papers generally contain a red-sensitive silver halide layer, a blue-sensitive silver halide layer, and a green-sensitive silver halide layer. The red-sensitive layer usually has a cyan dye-forming coupler associated therewith, the blue-sensitive layer usually has a yellow dye-forming coupler associated therewith, and the green-sensitive layer usually has a magenta dye-forming coupler associated therewith.

Photographic elements with which the present invention is useful generally include, in addition to the above-described light-sensitive layers, various additional layers, such as filter layers, subbing layers, interlayers, antihalation layers, and the like, as described in *Research Disclosure I.* This Research Disclosure item also describes various addenda, such as surfactants and other coating aids, dye stabilizers, antifoggants, development inhibitor releasing compounds, filter dyes, optical brighteners, antistatic compounds, and the like, that can be included in photographic elements useful in the present invention, either in separate layers or in any of the above-described layers.

The gelatin-containing layers in photographic elements that are advantageously hardened by treatment with the compounds of formula (I) may utilize gelatin as the only binder in the layers, or the gelatin may be combined with other materials. Such materials include, for example, dispersions of water insoluble or slightly soluble polymers, or hydrophilic colloidal polymer materials. Such materials include acrylamide polymers, acrylate polymers, vinyl alcohol polymers, halogenated styrene polymer, poly(sulfonic acid), poly(sulfinic acid), and others described in detail in *Research Disclosure I,* Section IX.

In one preferred embodiment of the invention, compounds according to formula (I) where at least one of the $X^{\ominus}$ ions is an anionic portion of the compound to form an intramolecular salt are advantageously utilized to harden gelatin compositions comprising gelatin and a negatively-charged hydrophobic dispersion. Such zwitterionic hardener compounds according to formula (I) have little adverse interaction with such dispersions.

This anionic portion of the compound can be a substituent on any of the R groups described above. Such anionic substituents are well-known in the art and include, for example, sulfato, sulfo, acyl sulfamoyl such as $SO_2NHCOR$ where R is alkyl of 1 to 6 carbon atoms such as methyl, ethyl, and the like, and phosphono such as $CH_2CH_2PO_3H_2$. In a preferred embodiment, $R_1$ and $R_2$ form a heterocyclic ring such as a pyridylium ring, $R_4$ and $R_5$ form a heterocyclic ring such as a pyridylium ring, and one of the $X^{\ominus}$ anions may be a substituent on $R_3$ or $R_6$ and the other of the $X^{\ominus}$ anions may be a substituent on the other of $R_3$ or $R_6$.

The negatively-charged dispersion of hydrophobic addenda includes any dispersion of a hydrophobic compound or composition, solid or liquid, having negatively-charged particles or droplets with mean diameters ranging from about 0.02 μm to 1.0 μm. Hydrophobic compounds or compositions useful in the practice of the invention include photographic couplers such as dye-forming couplers as described, for example, in *Research Disclosure I,* Section VII, development modifier-releasing couplers such as those described in U.S. Pat. No. 4,248,962 and *Research Disclosure I,* Section VII(F), optical brighteners such as those described in *Research Disclosure I,* Section V, ultraviolet absorbers such as those described in U.S. Pat. No. 4,195,999, oxidized developer scavengers such as those described in *Research Disclosure I,* Section VII(I) and U.S. Pat. Nos. 2,728,659 and 4,366,236, or combinations thereof.

The dispersion of hydrophobic addenda may be an oil-in-water type dispersion in which the hydrophobic addenda is a high-boiling water-insoluble organic liquid or is dissolved in a high-boiling water-insoluble organic solvent, such as dibutylphthalate, tricresyl phosphate, or diethyl lauramide. Such dispersions and techniques for preparing them are well-known in the art and are described, for example, in *Research Disclosure I,* Section XIV, U.S. Pat. No. 2,322,027, and James, *The Theory of the Photographic Process* 4th, 348–51, 1977. The dispersion may also be a dispersion of solid particles as described, for example in *Research Disclosure,* Item 16468, December, 1977 and G.B. Pat. No. 1,193,349, the disclosures of which are incorporated herein by reference. The dispersion may also be a latex dispersion of particles of a polymer having the photographic addenda bonded thereto, such as polymeric couplers as described in U.S. Pat. No. 4,612,278 and James, The Theory of the Photographic Process 4th, 347–48, 1977, the disclosures of which are incorporated herein by reference. Additionally, the dispersion may be a latex dispersion of polymer particles that may contain hydrophobic addenda, as described in *Research Disclosure,* Item 19551, July, 1980, Research Disclosure, Item 15930, July, 1977, and U.S. Pat. No. 4,304,769, the disclosures of which are incorporated herein by reference. The hydrophobic addenda that is dispersed may itself carry the negative charge instead of or in combination with an anionic surfactant. Such hydrophobes include micelle-forming couplers, which are known in the art. In a preferred embodiment, the hydrophobic dispersion is of a hydrophobic coupler in an oil in water type dispersion using a high-boiling water-insoluble organic solvent. The above dispersions and methods for preparing them are well-known in the art.

The droplets or particles of the dispersion of hydrophobic addenda are imparted with a negative charge through the use of a number of anionic surfactants that are well-known in the art. Anionic surfactants are described in *Research Disclosure I,* Section XI and *McCutcheons's Detergents and Emulsifiers,* Allured Publishing Corp., 1973, the disclosures of which are incorporated herein by reference. Such surfactants generally have a hydrophobic portion (preferably of 8 to 25 carbon atoms) appended to at least one anionic group, such as sulfo or sulfato. The hydrophobic portion is believed to associate with the hydrophobic particles or droplets in the dispersion such that the anionic group(s) appended thereto impart a negative charge to the dispersion particles or droplets. Examples of such surfactants include:

| | Compound |
|---|---|
| 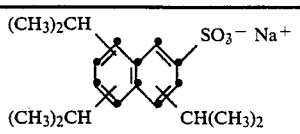 | S-1 |

-continued

| | Compound |
|---|---|
| 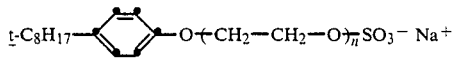 (n = 2–4) | S-2 |
| 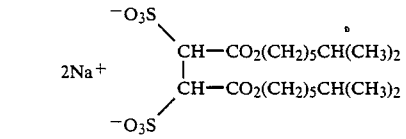 | S-3 |
| 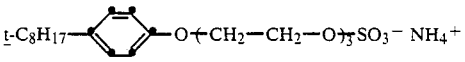 | S-4 |

The invention is further described in the following examples.

SYNTHESIS EXAMPLE 1

Bis(tetramethylformamidinium)ether ditriflate (compound 1)

To a solution of 11.6 g tetramethylurea in 100 ml $CH_2Cl_2$, 16.8 ml of triflic anhydride in 50 ml $CH_2Cl_2$ was added dropwise. The mixture was evaporated on a rotatory evaporator at room temperature to yield a yellowish oily residue. The residue was dissolved in 100 ml $CH_2Cl_2$ and 11.6 g tetramethylurea in 50 ml $CH_2Cl_2$ was added, at which point a precipitate was formed. The mixture was stirred under nitrogen overnight, after which the precipitate was filtered, washed with $CH_2Cl_2$, and dried to obtain a colorless crystalline material with a melting point of 258°–260° C. IR and NMR analysis indicated that the crystalline material was bis(tetramethylformamidinium)ether ditriflate.

SYNTHESIS EXAMPLE 2

Bis(1-methyl-2-pyridinium)ether ditriflate (compound 2)

To a solution of 0.2 moles of N-methyl-2-pyridone in 150 ml $CH_2Cl_2$, 16.8 ml of triflic anhydride was added dropwise. A precipitate formed and the mixture was stirred under nitrogen at room temperature for 72 hours. The precipitate was filtered, washed with $CH_2Cl_2$, and dried to yield a colorless crystalline material with a melting point of 193°–195° C. IR and NMR analysis indicated that the material was bis(1-methyl-2-pyridinium)ether ditriflate.

SYNTHESIS EXAMPLE 3

Compound 18

2,2'-Bispyridyl ether (4 g) (as prepared by the method described in Rec. Trav. Chim. 75, 647 (1957)) was dissolved in dry methylene chloride (30 ml) and ethylene sulfate (3 g) was added to the mixture, which was then heated under reflux for 4 hours. After being cooled, the reaction mixture was filtered to yield 6.1 g of a white solid [Intermediate A] having a melting point of 190° C. 16 g of this compound was prepared and collected and dissolved in a mixture of dry sulfolane (110 ml) and acetonitrile (110 ml). Ethylene sulfate (7 g) was added and the reaction mixture was heated under gentle reflux for 12 hours. After being cooled, the mixture was filtered and product washed with acetonitrile and ether.

The product was purified by dissolution in water followed by precipitation with ethyl alcohol to yield 11.2 g of compound 18. The compound had a melting point of 173° C. and NMR and IR spectra were in accord with the assigned structure.

SYNTHESIS EXAMPLE 2

Compound 19

4.5 g of Intermediate A was dissolved in a mixture of dry sulfolane (30 ml) and dry carbon tetrachloride (30 ml), and then methyl triflate (2.5 g) was added. The mixture was heated under reflux for 4 hours and the cooled. The product was filtered off and washed with methylene chloride. Purification was effected by stirring with warm ethyl alcohol followed by filtration to yield 5 g of compound 19. The compound had a melting point of 141° C. and the NMR and IR spectra were in accord with the assigned structure.

EXAMPLE 1

A test material was prepared by coating a layer containing a mixture of gelatin at a level of 900 mg/ft$^2$ and colloidal silver at a level of 45 mg/ft$^2$ onto an Estar TM film base. The coated film base was cut into a series of test strips, which were treated with hardening compounds of formula I from Table I and comparison hardening compounds shown in Table II by immersing each strip in an aqueous solution of the compound for 5 minutes, removing the excess solution from the surface of the element, and air-drying at 50° C. The degree of after-hardening was determined by measuring the hardness of the freshly hardened gelatin layer compared to the hardness of a hardened gelatin layer after aging. Hardness of the gelatin layer was measured by gradually immersing the test strip in a 0.8 weight percent aqueous solution of Takamine TM, a proteolytic enzyme, at a rate of 0.2 in/min. The solution was adjusted to a pH of 7.2 and held at 25° C. The wedge length (the length of the strip from where the gelatin was completely removed to the last part of the strip to contact the enzyme solution) was measured and the hardness of the gelatin layer was calculated using the formula:

$$\text{hardness} = \frac{(\text{mm wedge length})(5\ \text{min/in})}{(25.4\ \text{mm/in})(0.9\ \text{g/ft}^2)}$$

TABLE II

| Compound | |
|---|---|
| CH-1 | $CH_2{=}CH{-}SO_2{-}CH_2{-}SO_2{-}CH{=}CH_2$ |
| CH-2 | 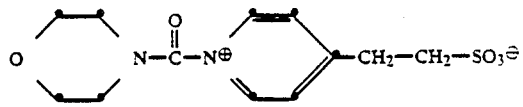 |
| CH-3 | 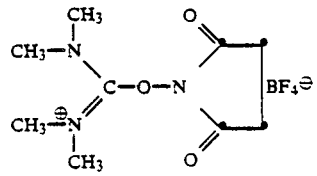 |
| CH-4 | 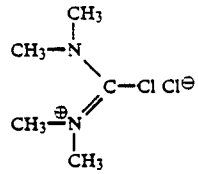 |
| CH-5 | 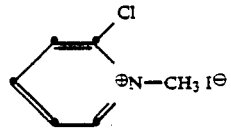 |

The results of this test are shown in Table III. Table III shows that compounds 1 and 2 of the invention resulted in no evidence of after-hardening, while compounds CH—1, CH—3, and CH—5 resulted in significant after-hardening. Table III also shows that compounds 1 and 2 of the invention yielded a higher degree of hardening than was achieved by an equivalent molar amount of the hardener compounds CH—1, CH—2, CH—3, CH—4, or CH—5.

TABLE III

| hardener | mmoles hardener per 100 g gelatin | enzymolysis hardness (mins. to erode 1 g/ft$^2$ gelatin) "fresh" (age) | aged (age) |
|---|---|---|---|
| 1 | 10 | 24.3 (0–6 day avg.) | 24.9 (6 days) |
| 1 | 15 | 33.3 (0–6 day avg.) | 30.6 (6 days) |
| 1 | 20 | 43.2 (0–4 day avg.) | 42.9 (4 days) |
| 2 | 10 | 33.3 (1 hr) | 32.6 (5 days) |
| CH-1 | 10 | 4.3 (5 hrs) | 18.0 (7 days) |
| CH-2 | 10 | 6.8 (0–14 day avg.) | 6.3 (14 days) |
| CH-2 | 15 | 8.6 (0–10 day avg.) | 8.5 (10 days) |
| CH-2 | 20 | 10.4 (1–10 day avg.) | 10.5 (10 days) |
| CH-3 | 10 | 5.9 (3 hrs) | 10.7 (8 days) |
| CH-3 | 15 | 12.0 (4 hrs) | 14.7 (6 days) |
| CH-3 | 20 | 11.2 (4 hrs) | 19.7 (6 days) |
| CH-4 | 10 | 17.5 (0–7 day avg.) | 16.0 (7 days) |
| CH-5 | 10 | 15.7 (2 hrs) | 26.5 (3 days) |

EXAMPLE 2

Test compositions were prepared having 6 weight percent gelatin, 100 ppm of a biocide (1,2-benzothiazolin-3-one), 10 mmole hardener (hardeners H-2, H-18, or H-19) per gram of gelatin, and either with or without a negatively-charged hydrophobic dispersion consisting of 2 weight percent of a (2:1) mixture of coupler C-1 and dibutylphthalate and 0.5% of surfactant S-1. The degree of gelatin cross-linking was determined by measuring the viscosity of the solution. The reciprocal viscosity was plotted as a function of time and the slope of the curve was used as a measure of the relative rate of cross-linking, with a more negative slope indicating a greater rate of cross-linking.

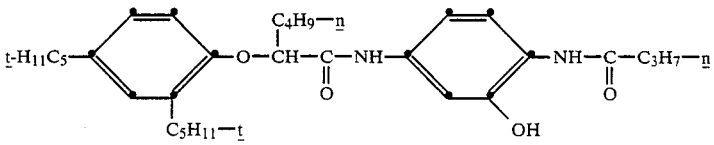

Figure 2:
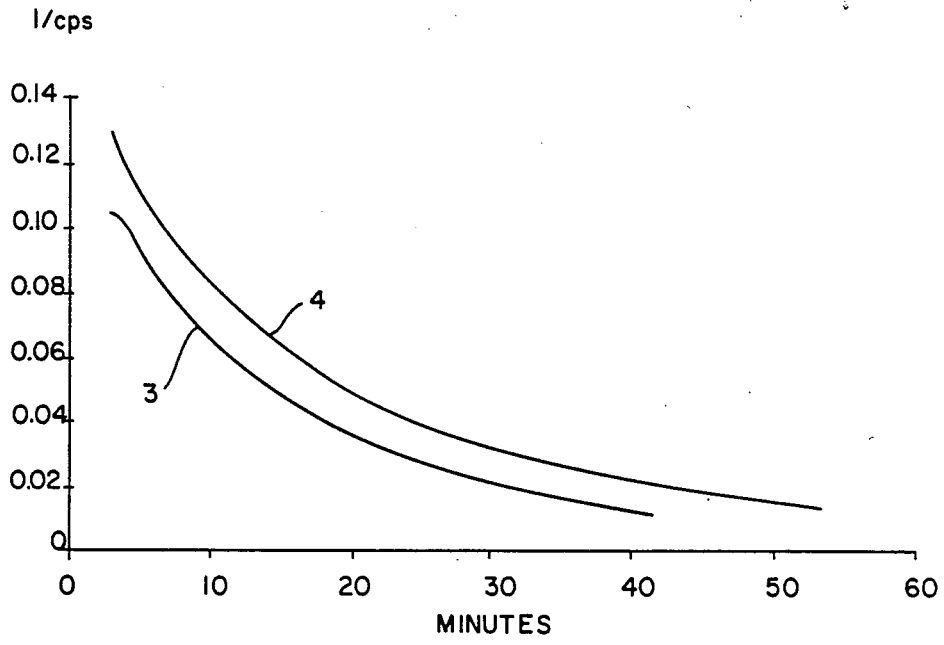
Figure 3:
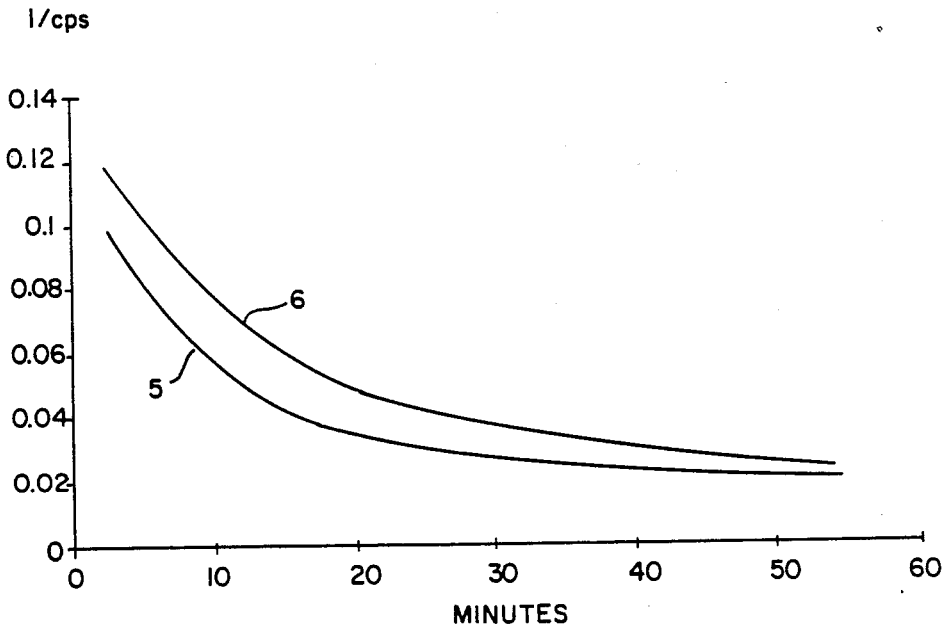

The results are presented in FIGS. 1–3. In FIG. 1, which is a plot of reciprocal viscosity versus time for a test solution containing the comparison hardener H-2 with and without the presence of the negatively-charged hydrophobic dispersion, curve 1 represents the plot for the test solution with no dispersion and curve 2 represents the plot for the test solution containing the dispersion. In FIG. 2, which is a plot of reciprocal viscosity versus time for a test solution containing the hardener H-18 with and without the presence of the negatively-charged hydrophobic dispersion, curve 4 represents the plot for the test solution with no dispersion and curve 3 represents the plot for the test solution containing the dispersion. In FIG. 3, which is a plot of reciprocal viscosity versus time for a test solution containing the hardener H-19 with and without the presence of the negatively-charged hydrophobic dispersion, curve 6 represents the plot for the test solution with no dispersion and curve 5 represents the plot for the test solution containing the dispersion.

As can be seen from the two curves in FIG. 1, curve 2 for the solution containing the negatively-charged hydrophobic dispersion exhibited a less negative slope than curve 1, indicating a lower rate of cross-linking. Curve 2 for the solution containing the dispersion also shows a higher equilibrium reciprocal viscosity than curve 1, which indicates that less cross-linking took place resulting in lower hardening efficiency.

FIGS. 2 and 3 represent plots of reciprocal viscosity versus time for dispersion-containing and non-dispersion-containing test solutions hardened by hardener compounds H-18 and H-19, respectively. In contrast to the hardener H-2 in FIG. 1, FIGS. 2 and 3 show that curves 3 and 5 for solutions containing the negatively-charged hydrophobic dispersion had approximately the same slope as curves 4 and 6 (as indicated by the approximately parallel curves) for solutions without the dispersions. Thus, the cross-linking rates of the hardener compounds H-18 and H-19 were not adversely effected by the presence of a negatively-charged hydrophobic dispersion. Also, the equilibrium viscosities of the test solutions indicated that the cross-linking efficiency for hardeners H-18 and H-19 was not adversely effected by the presence of the negatively-charged hydrophobic dispersion.

The invention has been described in detail with particular reference to preferred embodiments thereof, but it will be understood that variations and modifications can be effected within the spirit and scope of the invention.

What is claimed is:

1. A method for hardening gelatin, comprising combining gelatin and a compound of the formula:

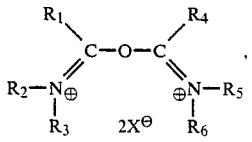

C-1 wherein $R_1$ represents hydrogen, alkyl of 1 to 20 carbon atoms, aralkyl of 7 to 20 carbon atoms, aryl of 6 to 20 carbon atoms, alkenyl of 2 to 20 carbon atoms, $—YR_7$, the group

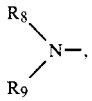

or the group

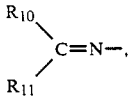

wherein Y represents sulfur or oxygen, and $R_7$, $R_8$, $R_9$, $R_{10}$, and $R_{11}$ each independently represents alkyl of 1 to 20 carbon atoms, aralkyl of 7 to 20 carbon atoms, aryl of 6 to 20 carbon atoms, or alkenyl of 2 to 20 carbon atoms, or $R_8$ and $R_9$ together form a heterocyclic ring, or $R_{10}$ and $R_{11}$ are each independently hydrogen or together form a ring structure, or $R_1$ together with $R_2$ or $R_3$ forms a heterocyclic ring, $R_2$ and $R_3$ each independently represents alkyl of 1 to 20 carbon atoms, aralkyl of 7 to 20 carbon atoms, aryl of 6 to 20 carbon atoms, or alkenyl of 2 to 20 carbon atoms, or, taken together with $R_1$ or each other, forms a heterocyclic ring, $R_4$, $R_5$, and $R_6$ are defined as are $R_1$, $R_2$, and $R_3$, respectively, and are the same as or different from $R_1$, $R_2$, or $R_3$, and $X^{\ominus}$ represents an anion or an anionic portion of the compound to form an intramolecular salt.

2. A method according to claim 1 wherein $R_1$ and $R_4$ each independently represents hydrogen, alkyl of 1 to 20 carbon atoms, aralkyl of 7 to 20 carbon atoms, aryl of 6 to 20 carbon atoms, alkenyl of 2 to 20 carbon atoms, $—YR_7$, the group

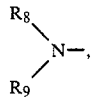

or the group

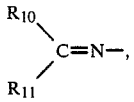

wherein Y represents sulfur or oxygen, and $R_7$, $R_8$, $R_9$, $R_{10}$, and $R_{11}$ each independently represents alkyl of 1 to 20 carbon atoms, aralkyl of 7 to 20 carbon atoms, aryl of 6 to 20 carbon atoms, or alkenyl of 2 to 20 carbon atoms, or $R_{10}$ and $R_{11}$ are each independently hydrogen, and $R_2$, $R_3$, $R_5$, and $R_6$ each independently represents alkyl of 1 to 20 carbon atoms, aralkyl of 7 to 20 carbon atoms, aryl of 6 to 20 carbon atoms, or alkenyl of 2 to 20 carbon atoms.

3. A method according to claim 1 wherein $R_1$ and $R_4$ each independently represents hydrogen, alkyl of 1 to 20 carbon atoms, aralkyl of 7 to 20 carbon atoms, aryl of 6 to 20 carbon atoms, alkenyl of 2 to 20 carbon atoms, —$YR_7$, or the group

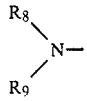

wherein Y represents sulfur or oxygen, and $R_7$, $R_8$, and $R_9$ each independently represents alkyl of 1 to 20 carbon atoms, aralkyl of 7 to 20 carbon atoms, aryl of 6 to 20 carbon atoms, or alkenyl of 2 to 20 carbon atoms, and $R_2$, $R_3$, $R_5$, and $R_6$ each independently represents alkyl of 1 to 20 carbon atoms, aralkyl of 7 to 20 carbon atoms, aryl of 6 to 20 carbon atoms, or alkenyl of 2 to 20 carbon atoms.

4. A method according to claim 3 wherein $R_1$ and $R_4$ each independently represents the group

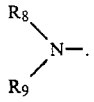

5. A method according to claim 4 wherein $R_2$, $R_3$, $R_5$, $R_6$, $R_8$, and $R_9$ each independently represents alkyl of 1 to 20 carbon atoms.

6. A method according to claim 5 wherein $R_2$, $R_3$, $R_5$, $R_6$, $R_8$, and $R_9$ are each methyl or ethyl.

7. A method according to claim 1 wherein at least one combination of two members of $R_1$, $R_2$, $R_3$, $R_4$, $R_5$, $R_8$, $R_9$, $R_{10}$, and $R_{11}$ forms a ring structure.

8. A method according to claim 7 wherein at least one combination of two members of $R_1$, $R_2$, $R_3$, $R_4$, $R_5$, and $R_6$ forms a heterocyclic ring.

9. A method according to claim 1 wherein at least one combination of either $R_1$ and $R_2$, or $R_4$ and $R_5$ forms a heterocyclic ring.

10. A method according to claim 9 wherein the heterocyclic ring is a pyridylium ring.

11. A method according to claim 1 wherein $R_1$ and $R_2$ form a pyridylium ring, $R_4$ and $R_5$ form a pyridilium ring, and $R_3$ and $R_6$ are each independently alkyl of 1 to 20 carbon atoms.

12. A method according to claim 11 wherein $R_3$ and $R_6$ are each methyl or ethyl.

13. A method according to any of claims 1, 7, 8, 9, 10, or 11 wherein said gelatin composition further comprises a negatively-charged hydrophobic dispersion and at least one $X^{\ominus}$ is an anionic portion of the compound to form an intramolecular salt.

14. A method according to any of claims 9, 10, or 11 wherein said gelatin composition further comprises a negatively-charged hydrophobic dispersion and at least one $X^{\ominus}$ is a substituent on $R_3$ or $R_6$ that is appended to a heterocyclic nitrogen.

15. A method according to claim 11 wherein said gelatin composition further comprises a negatively-charged hydrophobic dispersion and one $X^{\ominus}$ is a substituent on $R_3$ and the other $X^{\ominus}$ is a substituent on $R_6$.

16. A composition comprising gelatin hardened with a compound of the formula

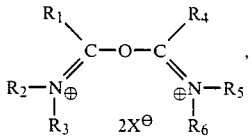

$R_1$ represents hydrogen, alkyl of 1 to 20 carbon atoms, aralkyl of 7 to 20 carbon atoms, aryl of 6 to 20 carbon atoms, alkenyl of 2 to 20 carbon atoms, —$YR_7$, the group

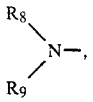

or the group

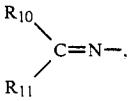

wherein Y represents sulfur or oxygen, and $R_7$, $R_8$, $R_9$, $R_{10}$, and $R_{11}$ each independently represents alkyl of 1 to 20 carbon atoms, aralkyl of 7 to 20 carbon atoms, aryl of 6 to 20 carbon atoms, or alkenyl of 2 to 20 carbon atoms, or $R_8$ and $R_9$ together form a heterocyclic ring, or $R_{10}$ and $R_{11}$ are each independently hydrogen or together form a ring structure, or $R_1$ together with $R_2$ or $R_3$ forms a heterocyclic ring, $R_2$ and $R_3$ each independently represents alkyl of 1 to 20 carbon atoms, aralkyl of 7 to 20 carbon atoms, aryl of 6 to 20 carbon atoms, or alkenyl of 2 to 20 carbon atoms, or, taken together with $R_1$ or each other, forms a heterocyclic ring, $R_4$, $R_5$, and $R_6$ are defined as are $R_1$, $R_2$, and $R_3$, respectively and are the same as or different from $R_1$, $R_2$, or $R_3$, and $X^{\ominus}$ represents an anion or an anionic portion of the compound to form an intramolecular salt.

17. A composition according to claim 16 wherein $R_1$ and $R_4$ each independently represents

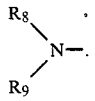

18. A composition according to claim 16 wherein at least one combination of either $R_1$ and $R_2$, or $R_4$ and $R_5$ forms a heterocyclic ring.

19. A composition according to claim 18 wherein said combination forms a pyridylium ring.

20. A composition according to claim 16 wherein $R_1$ and $R_2$ form a pyridylium ring, $R_4$ and $R_5$ form a pyridylium ring, and $R_3$ and $R_6$ are each independently alkyl of 1 to 20 carbon atoms.

21. A composition according to any of claims 16, 18, 19, or 20 wherein said composition further comprises a negatively-charged hydrophobic dispersion and at least one $X^{\Theta}$ is an anionic portion of the compound to form an intramolecular salt.

22. A composition according to any of claims 18, 19, or 20 wherein said composition further comprises a negatively-charged hydrophobic dispersion and at least one $X^{\Theta}$ is a substituent on $R_3$ or $R_6$ that is appended to a heterocyclic nitrogen.

23. A composition according to claim 20 wherein said composition further comprises a negatively-charged hydrophobic dispersion and one $X^{\Theta}$ is a substituent on $R_3$ and the other $X^{\Theta}$ is a substituent on $R_6$.

24. A composition according to any of claims 16–20 or 23 further comprising silver halide.

25. A composition according to claim 21 further comprising silver halide.

26. A composition according to claim 22 further comprising silver halide.

27. A photographic element comprising a support having thereon a layer comprising a composition according to claim 24.

28. A photographic element comprising a support having thereon a layer comprising a composition according to claim 25.

29. A photographic element comprising a support having thereon a layer comprising a composition according to claim 26.

* * * * *